US011781807B2

(12) United States Patent
Yao et al.

(10) Patent No.: US 11,781,807 B2
(45) Date of Patent: Oct. 10, 2023

(54) ROTATING LAMP, REFRIGERATOR, AND CONTROL METHOD FOR ROTATING LAMP IN REFRIGERATOR

(71) Applicants: Hefei Hualing Co., Ltd., Hefei (CN); Hefei Midea Refrigerator Co., Ltd., Hefei (CN); Midea Group Co., Ltd., Foshan (CN)

(72) Inventors: Nanfei Yao, Hefei (CN); Daojun Yu, Hefei (CN); Haibin Zhang, Hefei (CN); Baoyin Wang, Hefei (CN)

(73) Assignees: HEFEI HUALING CO., LTD., Hefei (CN); HEFEI MIDEA REFRIGERATOR CO., LTD., Hefei (CN); MIDEA GROUP CO., LTD., Foshan (CN)

( * ) Notice: Subject to any disclaimer, the term of this patent is extended or adjusted under 35 U.S.C. 154(b) by 0 days.

(21) Appl. No.: 17/963,110

(22) Filed: Oct. 10, 2022

(65) Prior Publication Data

US 2023/0032378 A1 Feb. 2, 2023

Related U.S. Application Data

(63) Continuation of application No. PCT/CN2020/135053, filed on Dec. 9, 2020.

(30) Foreign Application Priority Data

Apr. 14, 2020 (CN) ..... 202010291383.8

(51) Int. Cl.

| | |
|---|---|
| ***F21V 33/00*** | (2006.01) |
| ***F25D 27/00*** | (2006.01) |
| ***F21V 14/02*** | (2006.01) |
| ***F25D 29/00*** | (2006.01) |
| *F21W 131/305* | (2006.01) |

(52) U.S. Cl.

CPC ..... *F25D 27/005* (2013.01); *F21V 14/02* (2013.01); *F21V 33/0044* (2013.01);

(Continued)

(58) Field of Classification Search

CPC .... F21V 14/02; F21V 33/0044; F25D 27/005; F21W 2131/305

(Continued)

(56) References Cited

U.S. PATENT DOCUMENTS

2014/0168953 A1 6/2014 Madireddi et al.

FOREIGN PATENT DOCUMENTS

CN 1177092 A 3/1998
CN 201462758 U 5/2010

(Continued)

OTHER PUBLICATIONS

Midea Group Co., Ltd., 1st CN Office Action, CN Patent Application No. 202010291383.8, dated Feb. 3, 2022, 12 pgs.

(Continued)

*Primary Examiner* — Christopher M Raabe

(74) *Attorney, Agent, or Firm* — Morgan, Lewis & Bockius LLP

(57) ABSTRACT

The present disclosure provides a rotating lamp, a refrigerator, and a control method for a rotating lamp in a refrigerator. The rotating lamp is disposed in a box having a door and a drawer, the rotating lamp includes a driving device, a transmission mechanism and a lamp box assembly, and the driving device includes an output shaft; the lamp box assembly is rotatably arranged in the box and has a light exit surface; one end of the transmission mechanism is connected to the output shaft, and the other end is connected to the lamp box assembly. When the door is opened or when the drawer (30) is drawn out, the driving device drives the (Continued)

lamp box assembly via the transmission mechanism to rotate the lamp box assembly relative to the box.

13 Claims, 10 Drawing Sheets

(52) U.S. Cl.
CPC ..... *F25D 29/00* (2013.01); *F21W 2131/305* (2013.01); *F25D 2700/02* (2013.01)

(58) Field of Classification Search
USPC ..... 362/92
See application file for complete search history.

(56) References Cited

FOREIGN PATENT DOCUMENTS

| | | | | | |
|---|---|---|---|---|---|
| CN | 101821572 | A | | 9/2010 | |
| CN | 102494510 | A | | 6/2012 | |
| CN | 202304214 | U | | 7/2012 | |
| CN | 203464599 | U | | 3/2014 | |
| CN | 203927589 | U | | 11/2014 | |
| CN | 105115238 | A | | 12/2015 | |
| CN | 204923626 | U | | 12/2015 | |
| CN | 108344241 | A | | 7/2018 | |
| CN | 111609660 | A | | 9/2020 | |
| DE | 102014218511 | A1 | | 10/2015 | |
| DE | 102019203998 | A1 | * | 10/2020 | |
| EP | 2865975 | A1 | * | 4/2015 | ..... F21V 33/0044 |
| EP | 3026378 | A1 | | 6/2016 | |

OTHER PUBLICATIONS

Midea Group Co., Ltd., Notification to Grant Patent Right for Invention, CN Patent Application No. 202010291383.8, dated Apr. 27, 2021, 6 pgs.

Midea Group Co., Ltd., ISRWO, PCT/CN2020/135053, dated Feb. 25, 2021, 19 pgs.

* cited by examiner

ROTATING LAMP, REFRIGERATOR, AND CONTROL METHOD FOR ROTATING LAMP IN REFRIGERATOR

CROSS REFERENCE TO RELATED APPLICATIONS

The application is a continuation of International Patent Application No. PCT/CN2020/135053, filed Dec. 9, 2020, which claims priority to Chinese Patent Application No. 202010291383.8, filed Apr. 14, 2020, entitled "Rotating Lamp, Refrigerator, Control Method and Medium for Rotating Lamp in Refrigerator," each of which are hereby incorporated by reference in its entirety.

TECHNICAL FIELD

The present disclosure relates to the technical field of smart appliances, and in particular, to a rotating lamp, a refrigerator, and a control method for a rotating lamp in a refrigerator.

BACKGROUND

With the improvement of people's living standards, the demand for smart home appliances and smart homes is growing. How to make home appliances more intelligent and user-friendly is the technical direction that the home appliance industry needs to involve.

SUMMARY

The present disclosure provides a rotating lamp. The rotating lamp is disposed in a box. The box has a door and a drawer. The rotating lamp includes a driving device, a transmission mechanism and a lamp box assembly. The driving device includes an output shaft. The lamp box assembly is rotatably disposed in the box and has a light exiting surface. One end of the transmission mechanism is connected to the output shaft, and the other end is connected to the lamp box assembly. The driving device drives the lamp box assembly to rotate relative to the box when the door is opened or when the drawer is drawn out, such that the light exiting surface is rotated toward the inside of the box from a first position to a second position, or the light exiting surface is rotated from the second position to the first position when the drawer is opened.

The present disclosure provides a refrigerator. The refrigerator includes a box, a drawer, a door, and the rotating lamp as described above. The box defines a first receiving area and a second receiving area. The drawer is disposed in the second receiving area of the box. The door is connected to the box. The first receiving area of the box is arranged with the rotating lamp as described above.

The present disclosure provides a control method for a rotating lamp in a refrigerator. The method includes: detecting whether a door of the refrigerator is opened; in response to a signal that the door is opened, controlling a light exiting surface of the rotating lamp to rotate toward the inside of the refrigerator from a first position to a second position, and controlling the rotating lamp to turn on; in response to a signal that the door is closed, controlling the light exiting surface of the rotating lamp to rotate from the second position to the first position, and controlling the rotating lamp to turn off.

In the present disclosure, the driving device drives the lamp box assembly to rotate relative to the box by the transmission mechanism, so as to adjust a relative position of the light exiting surface of the lamp box assembly relative to the box. As a result, the irradiation direction of the light is adjusted, so as to flexibly adapt to the lighting requirements of different application scenarios.

BRIEF DESCRIPTION OF THE DRAWINGS

In order to illustrate the technical solutions in the embodiments of the present disclosure more clearly, the figures needed to be used in the descriptions of the embodiments will be briefly introduced in the following. Obviously, the drawings in the following description are only some embodiments of the present disclosure. Those skilled in the art may derive other figures from these figures without paying any creative work.

DETAILED DESCRIPTION

The present disclosure will be further described in detail with reference to the figures and embodiments of the present disclosure. In particular, the following embodiments are only used to illustrate the present disclosure, but not to limit the scope of the present disclosure. Similarly, the following embodiments are only a part of the embodiments of the present disclosure, rather than all the embodiments. All other embodiments obtained by those skilled in the art without any creative work are within the scope of the present disclosure.

Mentioning "embodiments" in the present disclosure means that a specific feature, structure, or characteristic described in conjunction with the embodiments may be included in at least one embodiment of the present disclosure. It is explicitly and implicitly understood by those skilled in the art that the embodiments described in the present disclosure may be combined with other embodiments.

If there are the descriptions of "first", "second", etc. in the embodiments of the present disclosure, the descriptions of "first", "second", etc. are only used for descriptive purposes, and cannot be understood as indicating or implying relative importance or implicitly indicating the number of indicated technical features. Thus, the features defined with "first", "second", etc. may explicitly or implicitly include at least one of the features. Further, the technical solutions of various embodiments can be combined with each other, but only on the basis that those skilled in the art can realize them. When the combination of the technical solutions is contradictory or cannot be realized, it shall be considered that such combination of the technical solutions does not exist and is not within the scope of the present disclosure.

After long-term research, the inventor of the present disclosure found that: even if a door of a box such as a refrigerator, a wardrobe, etc. is in an opened state, the light entering the box from the outside is finite; therefore, it is often necessary to install a lamp in the box to supplement the light, so as to facilitate the user to search for items. In the related art, the refrigerator is taken as an example, the lamp is usually installed and fixed to the top of a refrigerating chamber. In this way, on one hand, the light emitted by the lamp irradiates the user's eyes directly when the user opens the door of the refrigerator, thereby causing visual stimulation. On the other hand, a drawer located in a lower part of the refrigerating chamber is dark because of shelter from shelves and items on the shelves, so that it is not convenient to find out target items, thereby causing inconvenience to the user.

To address the problems as described above, the present disclosure provides the following embodiments.

Figure 1:
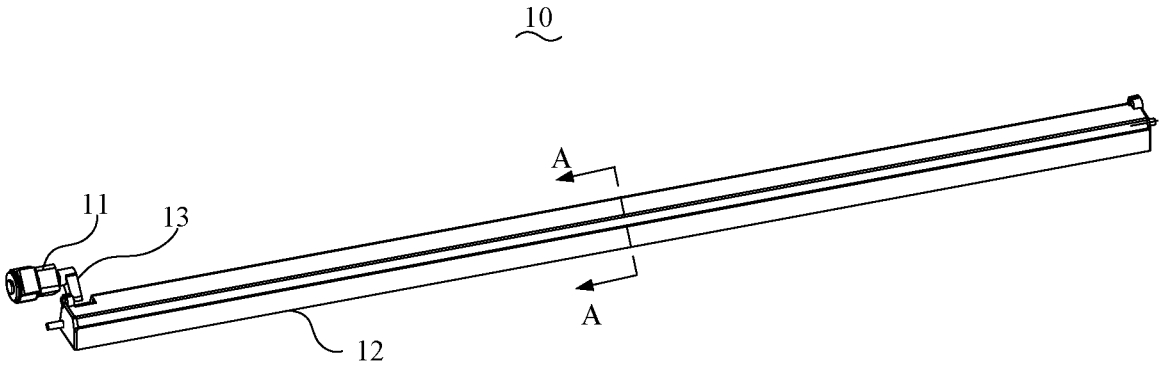
FIG. 1 is a schematic structural view of a rotating lamp according to some embodiments of the present disclosure.
Figure 2:
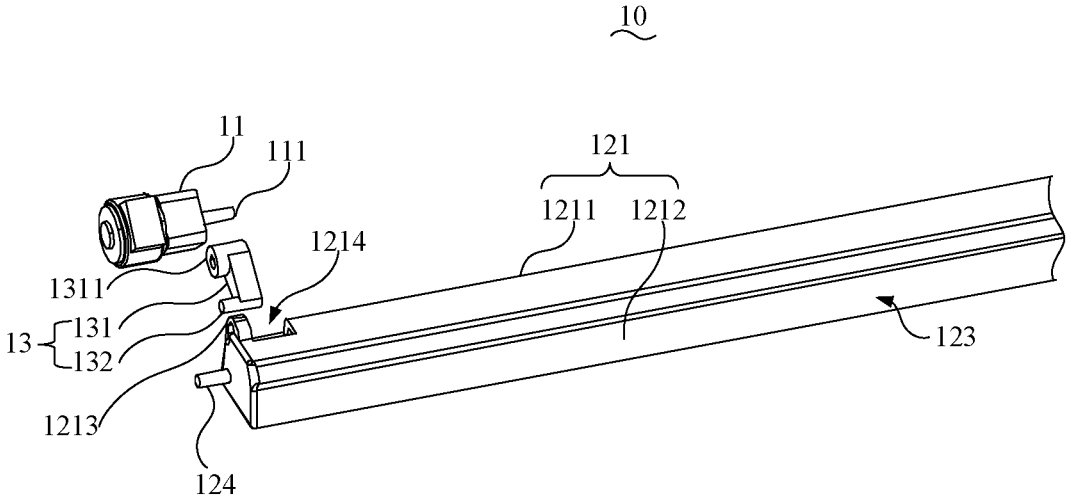
FIG. 2 is an exploded schematic structural view of the rotating lamp of FIG. 1.
Figure 3:
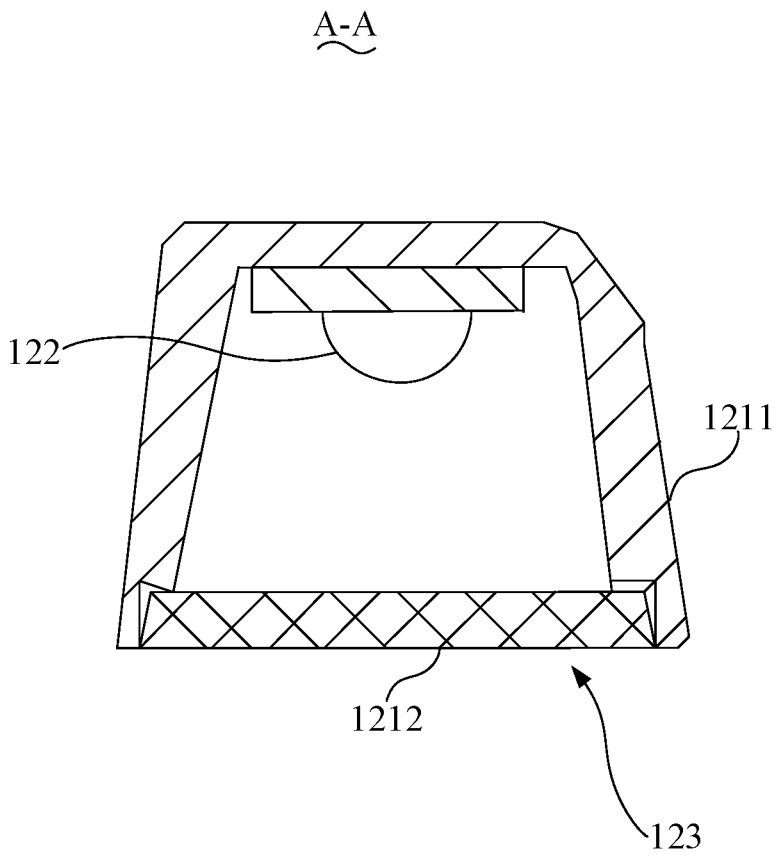
FIG. 3 is a cross-sectional schematic structural view of the rotating lamp of FIG. 1 along the A-A direction.

As shown in FIGS. 1-3, FIG. 1 is a schematic structural view of a rotating lamp according to some embodiments of the present disclosure, FIG. 2 is an exploded schematic structural view of the rotating lamp of FIG. 1, and FIG. 3 is a cross-sectional schematic structural view of the rotating lamp of FIG. 1 along the A-A direction.

In some embodiments, the rotating lamp 10 is disposed in a box. The box has a door and a drawer. The box is a refrigerator, a wardrobe, a cupboard, or the like. The rotating lamp 10 includes a driving device 11, a lamp box assembly 12, and a transmission mechanism 13. The transmission mechanism 13 connects the driving device 11 with the lamp box assembly 12. When the door is opened or the drawer is drawn out, the driving device 11 drives the lamp box assembly 12 to rotate relative to the box by the transmission mechanism 13.

In some embodiments, the lamp box assembly 12 includes a lamp box housing 121 and a light emitting element 122, as shown in FIG. 3. The lamp box housing 121 is rotatably disposed in the box. The lamp box housing 121 defines a receiving chamber 1210. The light emitting element 122 is disposed in the receiving chamber 1210. An opening 1215 of the receiving chamber 1210 constitutes the light exiting surface 123. The lamp box assembly 12 has at least one light exiting surface 123. The light exiting surface 123 is configured to allow the light emitted by the light emitting element 122 to pass through. The direction of the light exiting surface 123 relative to the box determines the direction of the majority of the light emitted by the light emitting element 122 relative to the box. The light emitting element 122 may be an LED (light emitting diode) lamp, a fluorescent lamp, an incandescent lamp, a halogen lamp, or the like.

In some embodiments, the lamp box housing 121 may include a lamp box 1211 and a lamp shade 1212. The lamp shade 1212 covers the opening 1215 of the receiving chamber 1210 to constitute the light exiting surface 123 of the lamp box assembly 12. The lamp box assembly 12 may be a strip-shaped lamp. The material of the lamp shade 1212 may be polycarbonate or ground glass, so that the light transmittance of the light emitting element 122 is improved and the light is soft.

In some embodiments, the lamp box assembly 12 further includes a rotating shaft 124. The rotating shaft 124 is rotatably connected to the box. The lamp box assembly 12 is rotated relative to the box with the rotating shaft 124 as the axis.

The driving device 11 includes an output shaft 111. The output shaft 111 may rotate in a first direction or a second direction opposite to the first direction. The rotational direction of the output shaft 111 determines the rotational direction of the lamp box assembly 12. For example, when the door is opened, the output shaft 111 rotates in the first direction, and the light exiting surface 123 of the lamp box assembly 12 is rotated toward the inside of the box from a first position to a second position. When the drawer is opened, the output shaft 111 rotates in the second direction, and the light exiting surface 123 of the lamp box assembly 12 is rotated from the second position to the first position. The first direction may refer to a clockwise direction, and the second direction may refer to a counterclockwise direction. Of course, the first direction may also refer to a counterclockwise direction, and the second direction may also refer to a clockwise direction.

In some embodiments, when the drawer is closed, the output shaft 111 rotates in the first direction, and the light exiting surface 123 of the lamp box assembly 12 is rotated from the first position to the second position. When the door is closed, the output shaft 111 rotates in the second direction, and the light exiting surface 123 of the lamp box assembly 12 is rotated from the second position to the first position.

The first position may refer to the position where the majority of the light passing through the light exiting surface 123 (when passing through the light exiting surface 123, part of the light may generate a diffuse reflection) is parallel to the door, or at a certain angle to the door. The second position may refer to the position where the majority of the light passing through the light exiting surface 123 is directed to the inside of the box. In some embodiments, the inside of the box refers to the space away from the door.

The driving device 11 is, for example, a motor.

The transmission mechanism 13 may include a transmission rod 131 and a first rotation connecting part 132. One end of the transmission rod 131 is connected to the output shaft 111 of the driving device 11, and the other end is provided with the first rotation connecting part 132.

One end of the transmission rod 131 is provided with a driving slot 1311. The output shaft 111 is fixed in the driving slot 1311 for power transmission.

For example, the output shaft 111 has external splines, the driving slot 1311 has internal splines. The internal splines are engaged with external splines, so as to achieve a fixed connection between the output shaft 111 and the transmission rod 131.

The lamp box housing 121 may further include a second rotation connecting part 1213. The second rotation connecting part 1213 may be disposed at a top corner of the lamp box housing 121 and spaced from the rotating shaft 124.

The second rotation connecting part 1213 is rotatably connected to the first rotation connecting part 132.

For example, the first rotation connecting part 132 is a cylindrical connecting pin, and the second rotation connecting part 1213 is a rotating groove. The first rotation connecting part 132 is inserted into the second rotation connecting part 1213, so as to achieve a rotatable connection between the transmission mechanism 13 and the lamp box assembly 12.

In some embodiments, the lamp box housing 121 defines a notch 1214 in a corner close to the second rotation connecting part 1213. In this way, when the first rotation connecting part 132 drives the second rotating connecting part 1213 to rotate, the possibility that the first rotation connecting part 132 collides with the lamp box housing 121 can be avoided, the rotation angle of the lamp box assembly 12 can be increased, the rotating lamp 10 can be compact, and the volume of the rotating lamp 10 can be reduced.

In the above embodiments, the output shaft 111 of the driving device 11 outputs power to drive the transmission mechanism 13 to rotate with the output shaft 111 as the axis, so that the transmission mechanism 13 drives the lamp box assembly 12 to rotate with the rotating shaft 124 as the axis. As a result, the light exiting surface 123 of the lamp box assembly 12 is rotated from the first position to the second position, or from the second position to the first position, thereby adjusting the irradiation direction of the light emitted by the lamp box assembly 12 in the box, to flexibly adapt to the lighting requirements of different application scenarios.

Figure 4:
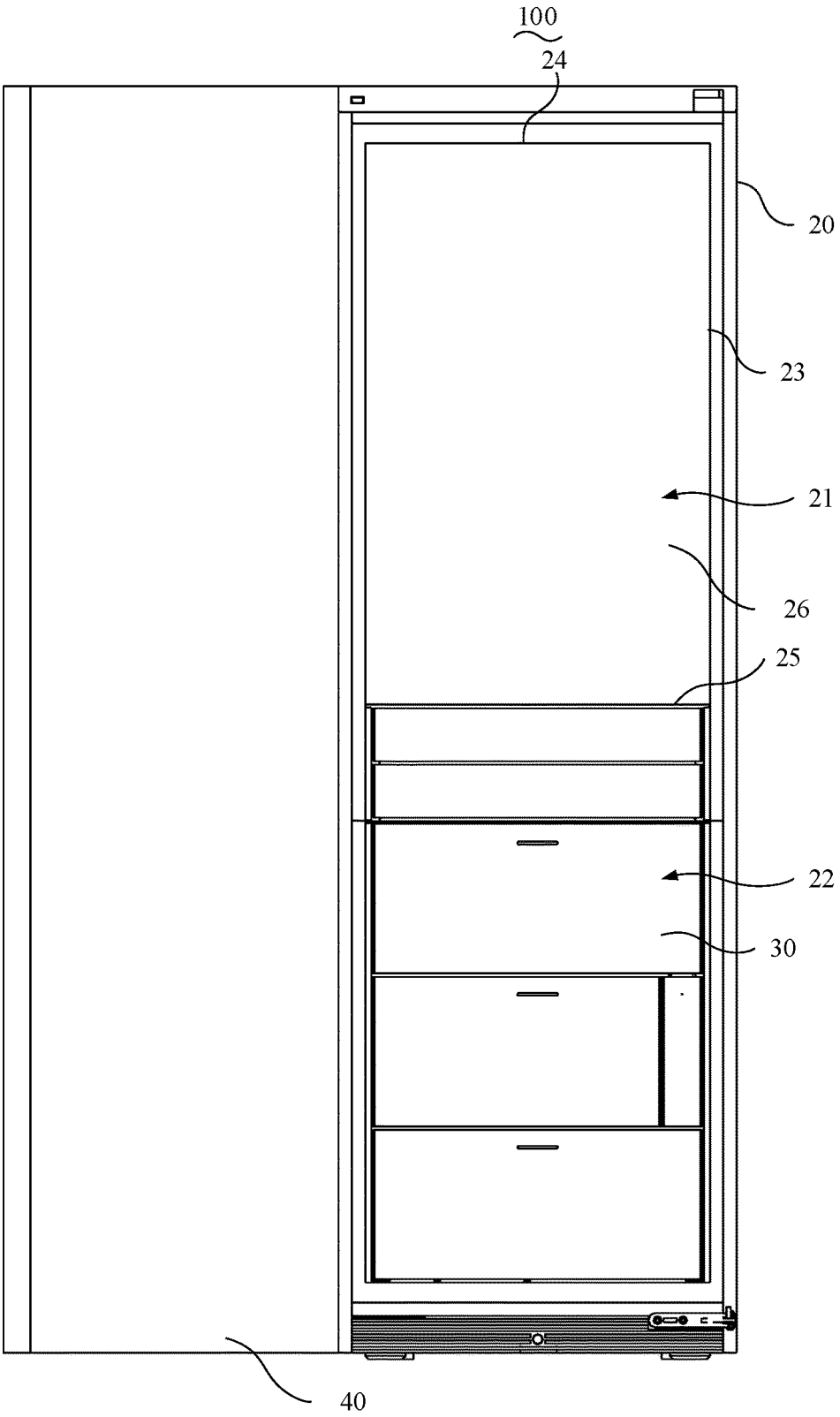
FIG. 4 is a front schematic structural view of a refrigerator according to some embodiments of the present disclosure.
Figure 5:
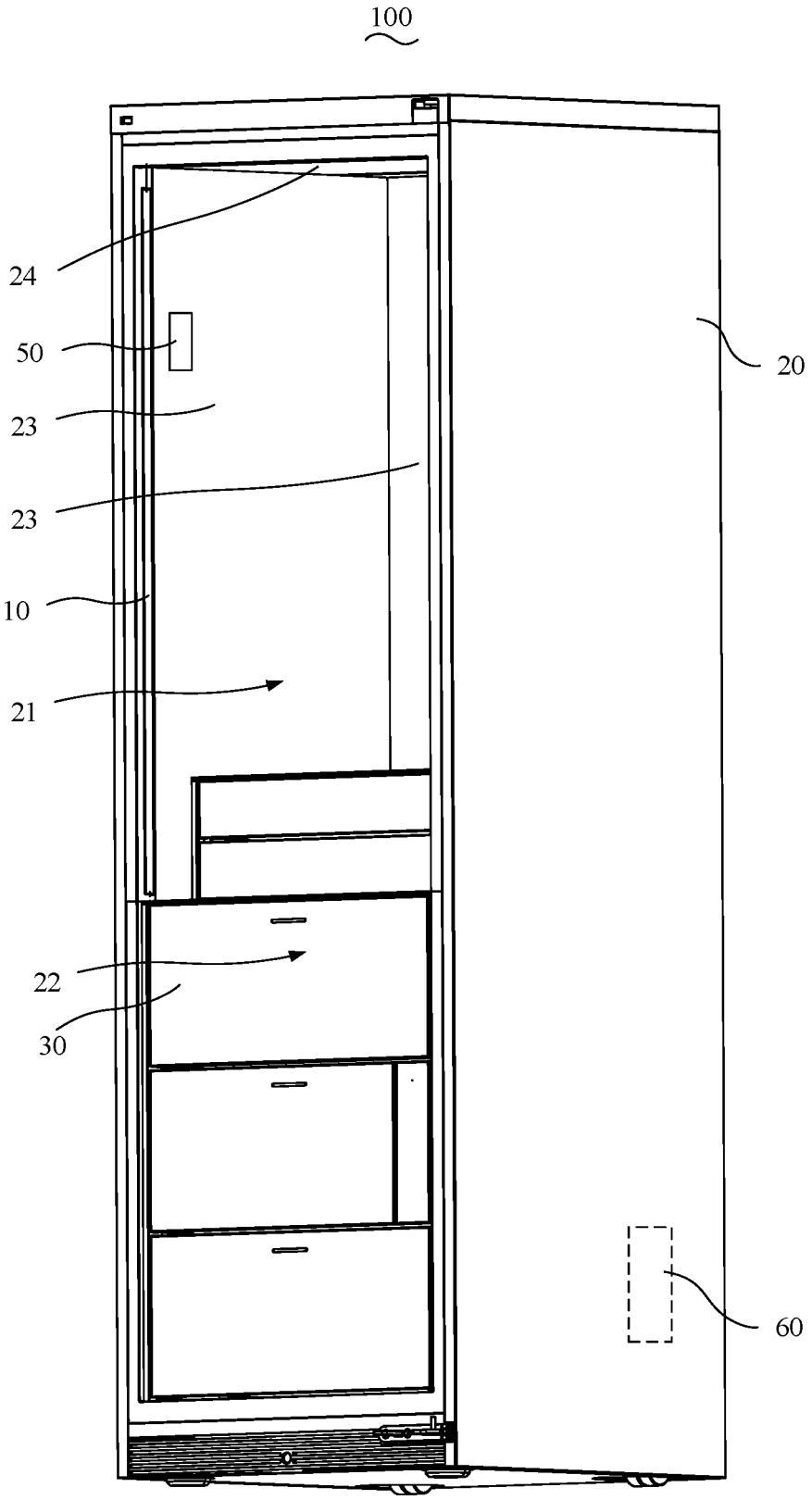
FIG. 5 is a side schematic structural view of the refrigerator of FIG. 4.
Figure 6:
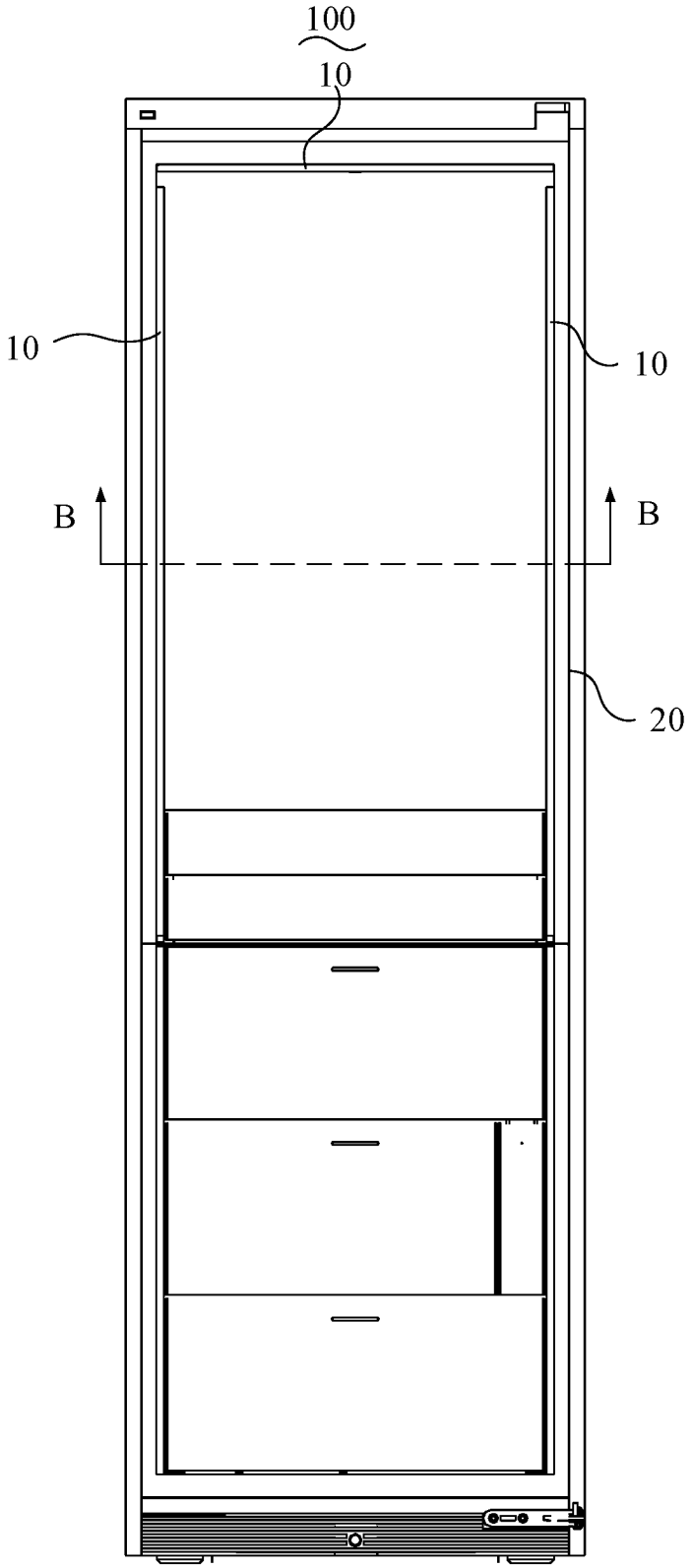
FIG. 6 is a schematic structural view of the refrigerator according to the present disclosure when a light exiting surface of the rotating lamp is in a second position.
Figure 7:
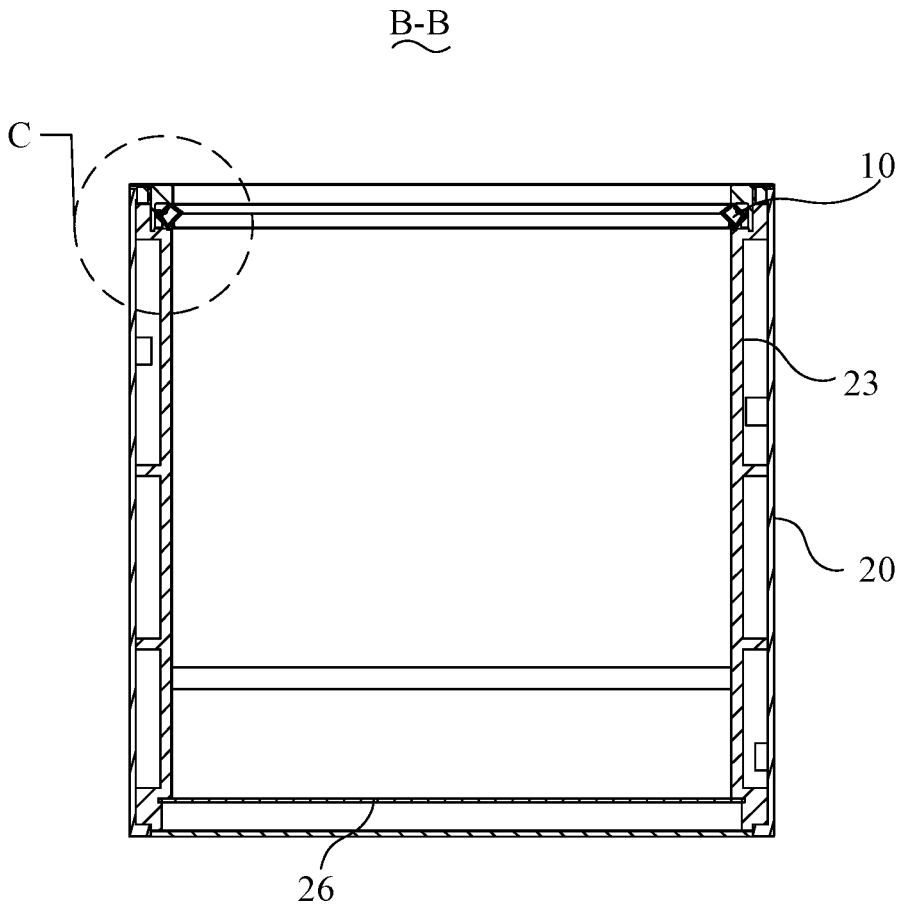
FIG. 7 is a cross-sectional schematic structural view of the refrigerator of FIG. 6 along the B-B direction.
Figure 8:
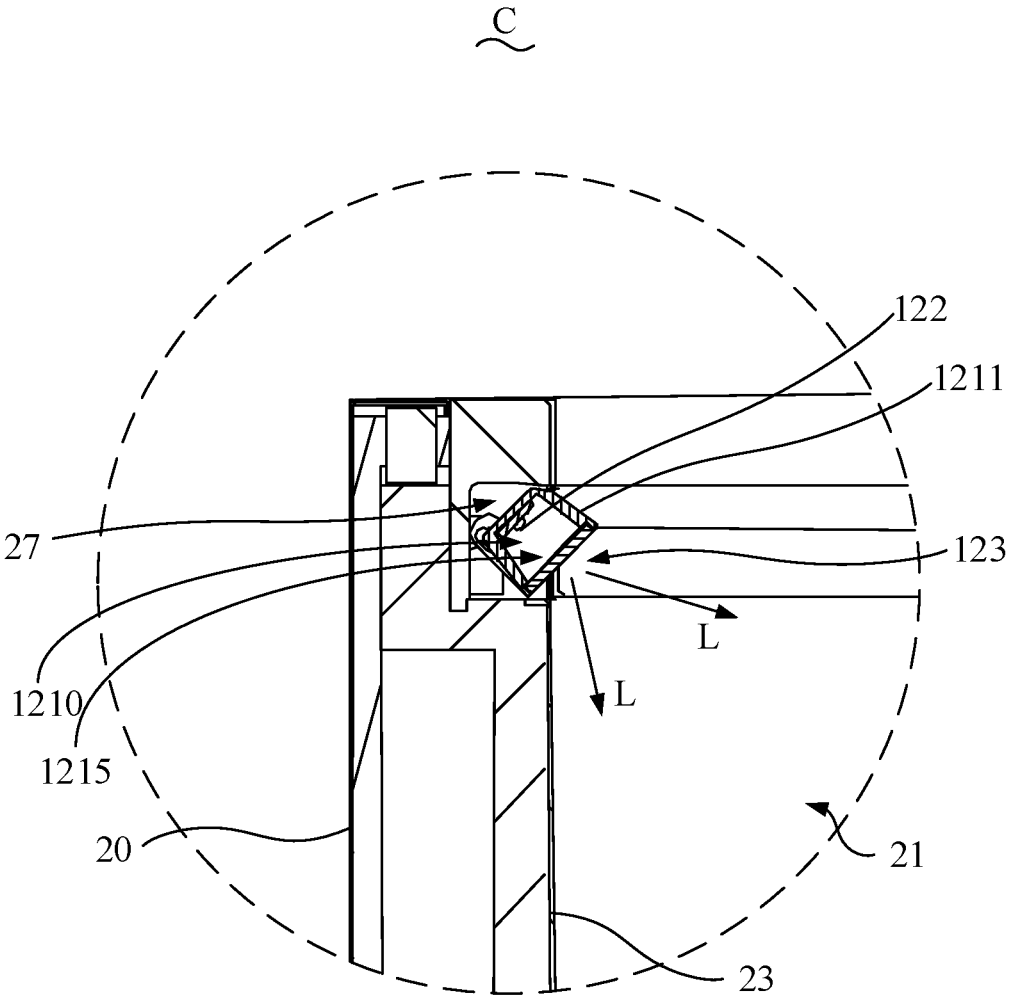
FIG. 8 is a partial enlarged schematic view of part C of FIG. 7.

As shown in FIG. 4, FIG. 4 is a front schematic structural view of a refrigerator according to some embodiments of the present disclosure, FIG. 5 is a side schematic structural view of the refrigerator of FIG. 4, FIG. 6 is a schematic structural view of the refrigerator according to the present disclosure when a light exiting surface of the rotating lamp is in a second position, FIG. 7 is a cross-sectional schematic structural view of the refrigerator of FIG. 6 along the B-B direction, and FIG. 8 is a partial enlarged schematic view of part C of FIG. 7.

In some embodiments, the refrigerator 100 includes a box 20, a drawer 30, a door 40, and the rotating lamp 10 of the embodiments as described above.

The door 40 is connected to the box 20. The drawer 30 and the rotating lamp 10 are disposed in the box 20.

When the door 40 is closed, the door 40 and the box 20 constitute a closed space cooperatively. When the door 40 is opened, the user can take out items from the box 20 or put items in the box 20.

The box 20 defines a first receiving area 21 and a second receiving area 22. The second receiving area 22 is, for example, an area where the drawer 30 is placed. The first receiving area 21 may be an area other than the area where the drawer 30 is placed. Shelves (not shown) may be placed in the first receiving area 21. The first receiving area 21 and the second receiving area 22 communicate with each other. For example, the first receiving area 21 and the second receiving area 22 are both part of a refrigerating chamber of the refrigerator 100.

In some embodiments, the box 20 includes two side walls 23 opposite to each other, a top wall 24, a bottom wall 25 opposite to the top wall 24, and a back wall 26 opposite to the door 40. The two side walls 23, the top wall 24, the bottom wall 25 and the back wall 26 cooperatively define the first receiving area 21 and the second receiving area 22.

In some embodiments, the lamp box assembly 12 is in the shape of a bar. The rotating lamp 10 is disposed on at least one of the two side walls 23 and the top wall 24.

For the lamp box assembly 12 disposed on the top wall 24, the light exiting surface 123 of the lamp box assembly 12 faces the bottom wall 25 or is parallel to the bottom wall 25 when in the first position; and the light exiting surface 123 of the lamp box assembly 12 is inclined to the back wall 26 and at a certain angle with the top wall 24 when in the second position. For the lamp box assembly 12 disposed on one of the two side walls 23, the light exiting surface 123 of the lamp box assembly 12 faces the other one of the two side walls 23 or is parallel to the other one of the two side walls 23 when in the first position; and the light exiting surface 123 of the lamp box assembly 12 is inclined to the back wall 26 and at a certain angle with the side wall 23 on which the lamp box assembly 12 is located when in the second position.

The number of the rotating lamps 10 disposed on each side wall 23 or top wall 24 can be adjusted according to actual needs. For example, it can be one, two or more. When both of the two side walls 23 and the top wall 24 are provided with the rotating lamps 10, the number of the rotating lamps 10 on the two side walls 23 and the top wall 24 may be the same or different. For example, the top wall 24 of the refrigerator 100 may be provided with two rotating lamps 10, and each side wall 23 may be provided with one rotating lamp 10 respectively. When the light exiting surfaces 123 of the two rotating lamps 10 located on the top wall 24 are in the second position, the angles between each light exiting surface 123 and the top wall 24 are different, so that the light in the spaces of different heights of the first receiving area 21 can be uniform, and the overall brightness of the refrigerator 100 can be improved.

The rotating lamp 10 may be embedded in the box 20, so that the available space of the refrigerator 100 can be improved. In some embodiments, the box 20 defines an installation groove 27. The rotating lamp 10 is arranged in the installation groove 27, as shown in FIG. 8. When located at the first position, the light exiting surface 123 of the lamp box assembly 12 is flush with the surface of the side wall 23 or the top wall 24, as shown in FIGS. 4 and 5. When the lamp box assembly 12 is rotated to a position where the light exiting surface 123 is located at the second position, a part of the lamp box assembly 12 protrudes from the surface of the top wall 24 or the side wall 23, as shown in FIGS. 6, 7 and 8. The directions of the arrows L in FIG. 8 indicate the range of the majority of the light emitted from the light exiting surface 123. It can be seen that when the light exiting surface 123 is located at the second position, the light emitted by the lamp box assembly 12 will basically not be directed towards the door 40, thereby reducing the visual stimulation of the light to the user.

The installation position of the lamp box assembly 12 is closer to the door 40 than the back wall 26. In this way, when the user opens the door 40, the lamp box assembly 12 may be rotated to a position where the light exiting surface 123 is located at the second position, the possibility that the light emitted by the lamp box assembly 12 irradiates the user's eyes directly is reduced, the light can be maximized, and the corner where the light is insufficient is reduced. The lamp box assembly 12 irradiates the user's eyes directly, thus resulting in the user's visual stimulation.

In some embodiments, the refrigerator 100 further includes an inductor 50 and a processor 60.

The inductor 50 is configured to sense that the door 40 is opened or closed, or that the drawer 30 is opened or closed. The inductor 50 may be a distance inductor, an infrared inductor or the like.

When the inductor 50 senses that the door 40 is opened, the processor 60 is configured to control the driving device 11 to drive the lamp box assembly 12 to rotate, and control the rotating lamp 10 to turn on. The driving device 11 drives the lamp box assembly 12 to rotate, so that the light exiting surface 123 is rotated from the first position to the second position. In this way, when the user opens the door 40 of the refrigerator 100, the visual stimulation of the light to the user can be reduced. Besides, the light exiting surface 123 is in the second position, such that the light inside the refrigerator 100 is sufficient, so that it is convenient for the user to search for or place items on the shelves.

In some embodiments, the processor 60 is configured to control the driving device 11 to drive the lamp box assembly 12 to rotate when the inductor 50 senses that the drawer 30 is opened, so that the light exiting surface 123 is rotated from the second position to the first position. Since the drawer 30 is generally disposed at a low position in the refrigerator 100, the user will lower his head and focus on the drawer 30 when searching for or placing items in the drawer 30. The drawer 30 will also be partially pulled out of the second receiving area 22, so that the light in the drawer 30 is insufficient. At this time, the light exiting surface 123 is rotated to the first position, which can improve the brightness in the drawer 30 without stimulating the user's vision, and facilitate the user to search for or place items in the drawer 30.

The processor 60 is further configured to control the driving device 11 to drive the lamp box assembly 12 to rotate when the inductor 50 senses that the drawer 30 is closed, so that the light exiting surface 123 is rotated from the first position to the second position. In this way, when the user's eyes may fall on the first receiving area, the light exiting surface 123 is rotated to face the inside of the refrigerator 100, that is, the second position, which can reduce the visual stimulation caused by the light to the user.

When the inductor 50 senses that the door 40 is closed, the processor 60 is configured to control the driving device 11 to drive the lamp box assembly 12 to rotate, and control the rotating lamp 10 to turn off, so as to reduce the power consumption of the rotating lamp 10. The driving device 11 drives the lamp box assembly 12 to rotate, so that the light exiting surface 123 is rotated from the second position to the first position.

In the above embodiments, the rotating lamp 10 is arranged in the box 20 of the refrigerator 100, so that when the refrigerator 100 senses that the door 40 is opened, the lamp box assembly 12 is driven to rotate until the light exiting surface 123 of the lamp box assembly 12 is located at the second position, so that the visual stimulation caused by the light emitted by the lamp box assembly 12 to the user is reduced. When the refrigerator 100 senses that the drawer 30 is opened, the lamp box assembly 12 is driven to rotate until the light exiting surface 123 is located at the first position, which can improve the brightness in the drawer 30 without stimulating the user's vision, and facilitate the user to search for or place items in the drawer 30. The rotating lamp 10 is disposed at a position closer to the door 40 than the back wall 26, so that the light can be maximized, and the corner where the light is insufficient is reduced. The lamp box assembly 12 is embedded in the box 20, so as to increase the available space of the refrigerator 100.

Figure 9:
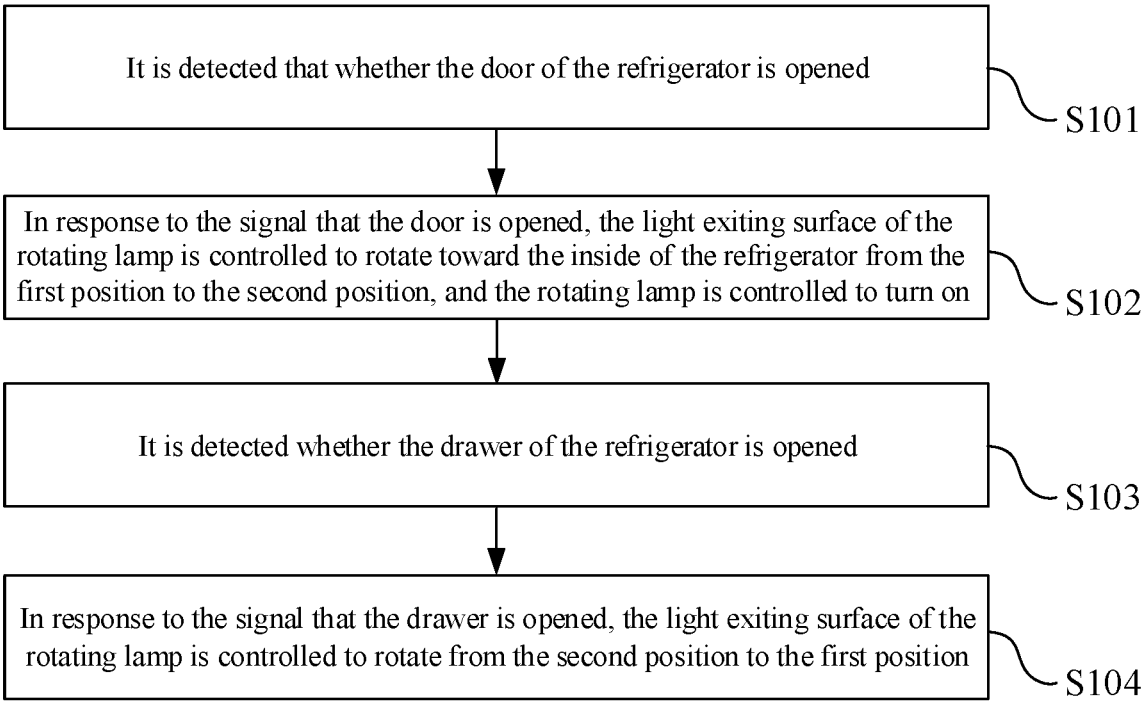
FIG. 9 is a schematic flow diagram of a control method for the rotating lamp in the refrigerator according to a embodiment of the present disclosure.

FIG. 9 is a schematic flow diagram of a control method for the rotating lamp in the refrigerator according to a first embodiment of the present disclosure.

S101: It is detected that whether the door of the refrigerator is opened.

The refrigerator detects whether the door is opened by its own inductor. If a signal that the door is opened from the inductor is received, S102 is performed.

S102: In response to the signal that the door is opened, the light exiting surface of the rotating lamp is controlled to rotate toward the inside of the refrigerator from the first position to the second position, and the rotating lamp is controlled to turn on.

The rotating lamp includes the driving device, the lamp box assembly, and the transmission mechanism. The driving mechanism connects the driving device with the lamp box assembly. When in operation, the driving device drives the lamp box assembly to rotate relative to the box by the driving mechanism. The lamp box assembly is rotatably arranged in the refrigerator, and has the light exiting surface.

In response to the signal that the door is opened, the refrigerator sends a first control command to the rotating lamp to activate the driving device, to rotate the output shaft of the driving device in the first direction, and to turn on the rotating lamp. The output shaft of the driving device rotates in the first direction, thereby driving the light exiting surface of the lamp box assembly to rotate toward the inside of the refrigerator from the first position to the second position by transmission mechanism.

The refrigerator includes the door, the two side walls opposite to each other, the top wall, the bottom wall opposite to the top wall, and the back wall opposite to the door. The door, the two side walls, the top wall, the bottom wall and the back wall define at least one receiving area cooperatively.

The lamp box assembly is in the shape of a bar. The rotating lamp is disposed on at least one of the two side walls and the top wall. For the lamp box assembly disposed on the top wall, the light exiting surface faces the bottom wall or is parallel to the bottom wall when in the first position; and the light exiting surface is inclined to the back wall and at a certain angle with the top wall when in the second position. For the lamp box assembly disposed on one of the two side walls, the light exiting surface faces the other one of the two side walls or is parallel to the other one of the two side walls when in the first position; and the light exiting surface is inclined to the back wall and at a certain angle with the side wall on which the lamp box assembly is located when in the second position.

S103: It is detected whether the drawer of the refrigerator is opened.

After detecting that the door of the refrigerator is open, the inductor continues to be used to detect whether the drawer of the refrigerator is opened. If a signal that the drawer is opened is received from the inductor, S104 is performed.

In some embodiments, the drawer refers to the drawer which is located in the receiving area in the refrigerator where the rotating lamp is located.

The inductor that detects whether the drawer is opened and the inductor that detects whether the door is opened may be the same inductor or two different inductors.

S104: In response to the signal that the drawer is opened, the light exiting surface of the rotating lamp is controlled to rotate from the second position to the first position.

In response to the signal that the drawer is opened, the refrigerator sends a second control command to the rotating lamp to activate the driving device, and to rotate the output shaft of the driving device in the second direction, thereby driving the light exiting surface of the lamp box assembly to rotate from the second position to the first position by the transmission mechanism. The second direction is opposite to the first direction.

In the above embodiments, when it is detected that the door of the refrigerator is opened, the driving device for controlling the rotating lamp drives and rotates the lamp box assembly until the light exiting surface of the lamp box assembly is located at the second position, so that the visual stimulation caused by the light emitted by the lamp box assembly to the user is reduced, and the light in the refrigerator is sufficient. When the inductor detects that the drawer of the refrigerator is opened, the driving device is controlled to drive the lamp box assembly to rotate, so that the light exiting surface is rotated from the second position to the first position. Since the drawer is generally disposed at a low position in the refrigerator, the user will lower his head and focus on the drawer when searching for or placing items in the drawer. The drawer will also be partially pulled out of the second receiving area, so that the light in the drawer is insufficient. At this time, the lamp box assembly is rotated to the first position, the brightness of the light in the drawer can be improved without stimulating the user's vision, and it is convenient for the user to search for or place items in the drawer.

Figure 10:
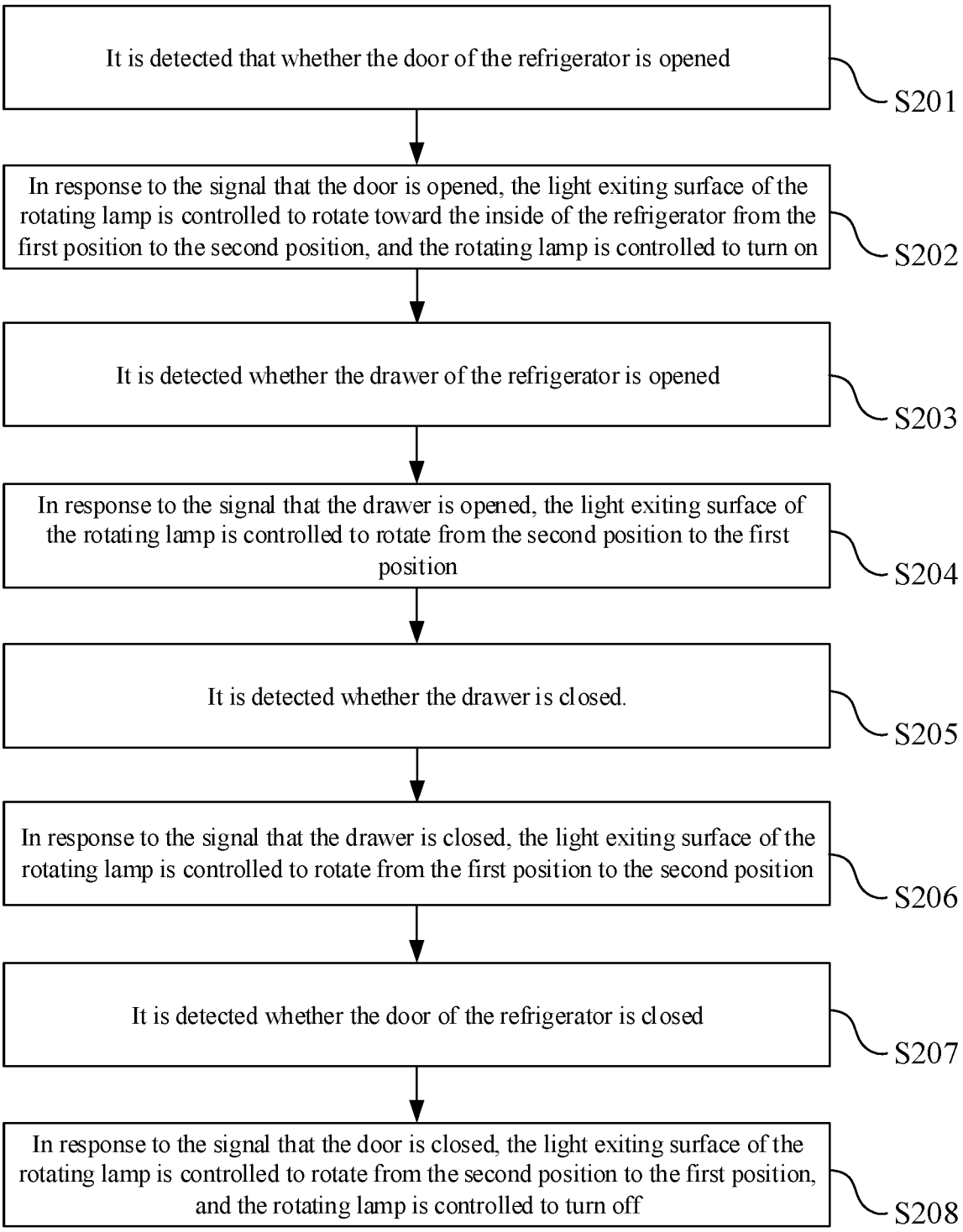
FIG. 10 is a schematic flow diagram of a control method for the rotating lamp in the refrigerator according to another embodiment of the present disclosure.

As shown in FIG. 10, FIG. 10 is a schematic flow diagram of a control method for the rotating lamp in the refrigerator according to a second embodiment of the present disclosure. The present embodiment is based on the first embodiment of the control method for a rotating lamp in a refrigerator, and the same operations are not repeated herein.

S201: It is detected that whether the door of the refrigerator is opened.

S202: In response to the signal that the door is opened, the light exiting surface of the rotating lamp is controlled to rotate toward the inside of the refrigerator from the first position to the second position, and the rotating lamp is controlled to turn on.

S203: It is detected whether the drawer of the refrigerator is opened.

S204: In response to the signal that the drawer is opened, the light exiting surface of the rotating lamp is controlled to rotate from the second position to the first position.

S205: It is detected whether the drawer is closed.

After receiving the signal that the drawer is opened, the refrigerator continues to detect whether the drawer is closed by the inductor.

If a signal that the drawer is closed is received, S206 is performed.

S206: In response to the signal that the drawer is closed, the light exiting surface of the rotating lamp is controlled to rotate from the first position to the second position.

If the drawer is closed, the user may look up and focus on the inside of the refrigerator again. At this time, in order to reduce the visual stimulation to the user caused by the light emitted by the rotating lamp, the refrigerator sends a third control command to the rotating lamp.

The third control command is configured to control the driving device to start, and control the rotating shaft of the driving device to rotate in the first direction, thereby driving the light exiting surface of the lamp box assembly to rotate from the first position to the second position.

S207: It is detected whether the door of the refrigerator is closed.

After detecting that the drawer is closed, it is continued to detect whether the door of the refrigerator is closed.

If a signal that the door is closed is received, S208 is performed.

S208: In response to the signal that the door is closed, the light exiting surface of the rotating lamp is controlled to rotate from the second position to the first position, and the rotating lamp is controlled to turn off.

In response to the signal that the door is closed, the refrigerator sends a fourth control command to the rotating lamp to activate the driving device, to rotate the output shaft of the driving device in the second direction, and to turn off the rotating lamp. The output shaft of the driving device rotates in the second direction, thereby driving the light exiting surface of the lamp box assembly from the second position to the first position by the transmission mechanism.

In the above embodiments, it is detected whether the door of the refrigerator is opened. When the refrigerator senses that the door is opened, the lamp box assembly is driven to rotate until the light exiting surface of the lamp box assembly is located at the second position, thereby reducing the visual stimulation of the light emitted by the lamp box assembly to the user. When the refrigerator detects that the drawer is opened, the lamp box assembly is driven to rotate until the light exiting surface is in the first position, which can improve the brightness of the light in the drawer without stimulating the user's vision, and facilitate the user to search for or place items in the drawer. Further, when it is detected that the drawer is closed, the light exiting surface of the lamp box assembly is controlled to rotate from the first position to the second position, thereby reducing the visual stimulation caused by the light emitted by the lamp box assembly to the user. When it is detected that the door is closed, the light exiting surface of the rotating lamp is controlled to rotate from the second position to the first position, and the rotating lamp is controlled to turn off, so as to reduce the power consumption of the rotating lamp. In different scenarios, the rotating lamp in the refrigerator can be flexibly controlled to rotate according to the user's operation action on the refrigerator to adjust the illumination direction of the light, so that the light can adapt to the user's demand for the light.

Figure 11:
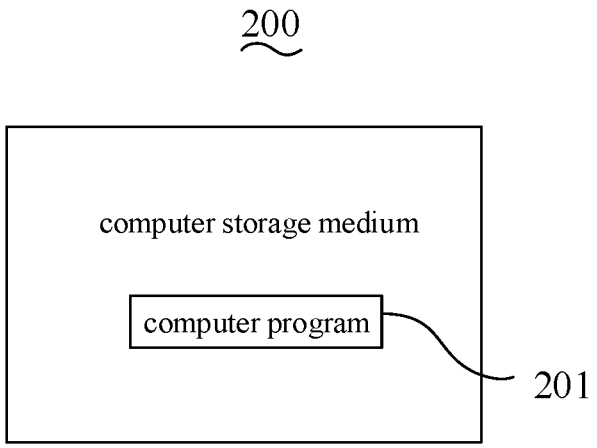
FIG. 11 is a schematic structural view of a computer storage medium according to some embodiments of the present disclosure.

The method of the above-mentioned embodiments of the control method for a rotating lamp in a refrigerator may exist in the form of a computer program, therefore the present disclosure proposes a computer storage medium. As shown in FIG. 11, FIG. 11 is a schematic structural view of a computer storage medium according to some embodiments of the present disclosure. A computer program 201 is stored in the computer storage medium 200. The computer program 201 can be performed to implement the methods as described in the above-mentioned embodiments.

In some embodiments, the computer storage medium 200 may be a medium that can store program instructions, such as a U disk, a removable hard disk, a read-only memory (ROM), a random access memory (RAM), a magnetic disk, or an optical disk, or may also be a server that stores program instructions, the server can send the program instructions stored therein to other devices to run, or may also run the program instructions stored therein by itself.

The above description are only embodiments of the present disclosure, and do not limit the scope of the present disclosure. Any equivalent structure or equivalent process transformation made by using the contents of the description and drawings of the present disclosure, or directly or indirectly used in other related technical fields, are similarly included in the scope of patent protection of the present disclosure.

What is claimed is:

1. A rotating lamp configured to be disposed in a box having a door and a drawer, the rotating lamp comprising:

a driving device comprising an output shaft;

a lamp box assembly rotatably arranged in the box and having a light exiting surface; and a transmission mechanism, one end of the transmission mechanism being connected to the output shaft, and the other end of the transmission mechanism being connected to the lamp box assembly;

wherein in response to detecting the door being opened or the drawer being drawn out, the driving device is configured to drive the lamp box assembly to rotate relative to the box by the transmission mechanism, and in response to the door being opened, the light exiting surface is configured to be rotated toward an inside of the box from a first position to a second position, and in response to the drawer being opened, the light exiting surface is rotated from the second position to the first position.

2. The rotating lamp of claim 1, wherein the lamp box assembly comprises a lamp box housing and a light emitting element, the lamp box housing is rotatably disposed in the box, the lamp box housing defines a receiving chamber, the light emitting element is disposed in the receiving chamber, and an opening of the receiving chamber forms the light exiting surface.

3. The rotating lamp of claim 2, wherein the transmission mechanism comprises a transmission rod and a first rotation connecting part, one end of the transmission rod is connected to the output shaft of the driving device, and the other end of the transmission rod is provided with the first rotation connecting part; the lamp box housing is arranged with a second rotation connecting part, the second rotation connecting part is spaced from a rotating shaft of the lamp box housing, and the first rotation connecting part is configured to be rotatably connected to the second rotation connecting part.

4. A refrigerator comprising:

a box defining a first receiving area and a second receiving area;

a drawer disposed in the second receiving area of the box; and a door connected to the box;

wherein the first receiving area of the box is arranged with a rotating lamp, and the rotating lamp comprises:

a driving device comprising an output shaft;

a lamp box assembly rotatably arranged in the box and having a light exiting surface; and a transmission mechanism, one end of the transmission mechanism being connected to the output shaft, and the other end being connected to the lamp box assembly;

wherein in response to the door being opened or the drawer being drawn out, the driving device is configured to drive the lamp box assembly to rotate relative to the box by the transmission mechanism, in response to detecting the door being opened, the light exiting surface is configured to rotate toward an inside of the box from a first position to a second position, and in response to detecting the drawer being opened, the light exiting surface is rotated from the second position to the first position.

5. The refrigerator of claim 4, wherein the box comprises two side walls opposite to each other and a top wall, the two side walls and the top wall cooperatively define the first receiving area; and the lamp box assembly is in a shape of a bar and disposed on at least one of the two side walls and the top wall.

6. The refrigerator of claim 4, wherein the box further comprises a back wall, and the lamp box assembly is disposed closer to the door than the back wall.

7. The refrigerator of claim 5, wherein the box further comprises a bottom wall opposite to the top wall; for the lamp box assembly disposed on the top wall, the light exiting surface of the lamp box assembly faces the bottom wall in the first position; and for the lamp box assembly disposed on one of the two side walls, the light exiting surface of the lamp box assembly faces the other one of the two side walls in the first position.

8. The refrigerator of claim 4, wherein the refrigerator further comprises:

an inductor configured to sense whether the door is opened or closed, and whether the drawer is opened or closed; and a processor configured to perform operations comprising: in response to sensing, by the inductor, that the door is opened, the processor is configured to control the driving device to drive the lamp box assembly to rotate and control the rotating lamp to turn on, and the light exiting surface is rotated from the first position to the second position; in response to t sensing, by the inductor, that the drawer is opened, the processor is configured to control the driving device to drive the lamp box assembly to rotate, and the light exiting surface is rotated from the second position to the first position.

9. The refrigerator of claim 8, wherein in response to sensing, by the inductor, that the drawer is closed, the processor is further configured to control the driving device to drive the lamp box assembly to rotate, and the light exiting surface is rotated from the first position to the second position; in response to sensing, by the inductor, that the door is closed, the processor is further configured to control the driving device to drive the lamp box assembly to rotate and control the rotating lamp to turn off, and the light exiting surface is rotated from the second position to the first position.

10. The refrigerator of claim 4, wherein the lamp box assembly comprises a lamp box housing and a light emitting element, the lamp box housing is rotatably disposed in the box, the lamp box housing defines a receiving chamber, the light emitting element is disposed in the receiving chamber, and an opening of the receiving chamber constitutes the light exiting surface.

11. The refrigerator of claim 10, wherein the transmission mechanism comprises a transmission rod and a first rotation connecting part, one end of the transmission rod is connected to the output shaft of the driving device, and the other end of the transmission rod is provided with the first rotation connecting part; the lamp box housing is arranged with a second rotation connecting part, the second rotation connecting part is spaced from a rotating shaft of the lamp box housing, and the first rotation connecting part is rotatably connected to the second rotation connecting part.

12. A control method for a rotating lamp in a refrigerator, the method comprising:

detecting whether a door of the refrigerator is opened;

in response to detecting that the door is opened, controlling a light exiting surface of the rotating lamp to rotate toward an inside of the refrigerator from a first position to a second position and controlling the rotating lamp to turn on;

detecting whether a drawer of the refrigerator is opened; and in response to detecting that the drawer is opened, controlling the light exiting surface of the rotating lamp to rotate from the second position to the first position.

13. The method of claim 12, wherein after controlling the light exiting surface of the rotating lamp to rotate from the second position to the first position, the method further comprises:

detecting whether the drawer is closed;

in response to detecting that the drawer is closed, controlling the light exiting surface of the rotating lamp to rotate from the first position to the second position;

detecting whether the door of the refrigerator is closed; and in response to a detecting that the door is closed, controlling the light exiting surface of the rotating lamp to rotate from the second position to the first position, and controlling the rotating lamp to turn off.

* * * * *